US009358545B2

(12) United States Patent
Bergman et al.

(10) Patent No.: US 9,358,545 B2
(45) Date of Patent: Jun. 7, 2016

(54) GYRATORY CRUSHER SPIDER ARM SHIELD

(71) Applicant: SANDVIK INTELLECTUAL PROPERTY AB, Sandviken (SE)

(72) Inventors: Axel Bergman, Malmo (SE); Bengt-Arne Eriksson, Svedala (SE); Mikael M. Larsson, Eslov (SE); Patric Malmqvist, Svedala (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 0 days.

(21) Appl. No.: 14/773,371

(22) PCT Filed: Jan. 27, 2014

(86) PCT No.: PCT/EP2014/051513

§ 371 (c)(1),
(2) Date: Sep. 7, 2015

(87) PCT Pub. No.: WO2014/135306

PCT Pub. Date: Sep. 12, 2014

(65) Prior Publication Data

US 2016/0016175 A1 Jan. 21, 2016

(30) Foreign Application Priority Data

Mar. 8, 2013 (EP) ..... 13158306

(51) Int. Cl.
*B02C 2/06* (2006.01)

(52) U.S. Cl.
CPC ..... *B02C 2/06* (2013.01)

(58) Field of Classification Search
CPC ..... B02C 2/06; B02C 2/042
USPC ..... 241/207–216
See application file for complete search history.

(56) References Cited

U.S. PATENT DOCUMENTS

| | | | |
|---|---|---|---|
| 1,791,584 | A | 2/1931 | Symons |
| 2,489,936 | A | 11/1949 | Shafter |
| 2,832,547 | A | 4/1958 | Kennedy |
| 3,026,051 | A | 3/1962 | Saari |
| 4,065,064 | A | 12/1977 | Anthony |
| 6,536,693 | B2 | 3/2003 | Van Mullem et al. |
| 2002/0088888 | A1 | 7/2002 | Van Mullem |
| 2009/0008489 | A1 | 1/2009 | Nieminen et al. |
| 2011/0192927 | A1 | 8/2011 | Biggin et al. |

FOREIGN PATENT DOCUMENTS

| | | | |
|---|---|---|---|
| GB | 1570015 | | 5/1980 |
| JP | 2004136252 | A | 5/2004 |
| WO | 2004110626 | A1 | 12/2004 |
| WO | 2008140375 | A1 | 11/2008 |
| WO | 2010123431 | A1 | 10/2010 |
| WO | 2011029140 | A1 | 3/2011 |
| WO | 2012005651 | A1 | 1/2012 |

*Primary Examiner* — Mark Rosenbaum
(74) *Attorney, Agent, or Firm* — Corinne R. Gorski

(57) ABSTRACT

A gyratory crusher spider arm shield is configured for releasable attachment to a spider arm. The shield includes a main body having an underside foot for engaging onto an upper region of the arm. The secure attachment is provided by cooperation between an attachment element that extends radially inward from an outermost end of the shield and a mount guide provided at sidewalls of the shield that extend laterally each side of the spider arm.

15 Claims, 10 Drawing Sheets

GYRATORY CRUSHER SPIDER ARM SHIELD

RELATED APPLICATION DATA

This application is a §371 National Stage Application of PCT International Application No. PCT/EP2014/051513 filed Jan. 27, 2014 claiming priority of EP Application No. 13158306.4, filed Mar. 8, 2013.

FIELD OF INVENTION

The present invention relates to a gyratory crusher spider arm shield and in particular, although not exclusively, to a shield configured for the convenient mounting and dismounting at the spider arm so as to protect the arm from material to be crushed as it falls into the crushing zone.

BACKGROUND ART

Gyratory crushers are used for crushing ore, mineral and rock material to smaller sizes. Typically, the crusher comprises a crushing head (referred to as a mantle) mounted upon an elongate main shaft. A first crushing shell is mounted on the crushing head and a second crushing shell is mounted on a frame such that the first and second crushing shells define together a crushing chamber through which the material to be crushed is passed. A driving device positioned at a lower region of the main shaft is configured to rotate an eccentric assembly positioned about the shaft to cause the crushing head to perform a gyratory pendulum movement and crush the material introduced in the crushing chamber. Example gyratory crushers are described in WO 2004/110626; WO 2008/140375, WO 2010/123431, US 2009/0008489, GB 1570015, U.S. Pat. No. 6,536,693, JP 2004-136252, U.S. Pat. No. 1,791,584 and WO 2012/005651.

The main shaft is supported at its uppermost end by a top bearing housed within a central hub that forms a part of a spider assembly mounted on top of the topshell frame part. Spider arms project radially outward from the central hub to contact an outer rim at the top shell. The material to be crushed typically falls through the region between the spider arms and is prevented from causing damage to the arms by shields mounted over and about each arm. Example shields are disclosed in U.S. Pat. No. 2,489,936; U.S. Pat. No. 2,832,547; U.S. Pat. No. 3,026,051; US 2002/0088888; US 2011/0192927. It is noted, these shields are typically secured to the spider arm via attachment bolts that project axially downward relative to the longitudinal axis of the main shaft. However, such configurations are disadvantageous as the bolt heads are exposed to the crushable material as it falls into the crushing chamber. With use, the bolt heads become damaged leading to attachment failure and subsequent loss of the shield that falls downwardly into the crushing chamber.

An alternative method of shield attachment involves welding the guards to the uppermost region of the spider arms. However, the welding process is both labour and time intensive and introduces additional problems when the worn shield needs removing. Additionally, the welding creates tension and stress concentrations into the spider arms. What is required is a spider arm shield that addresses the above problems.

SUMMARY OF THE INVENTION

It is an objective of the present invention to provide a shield or guard for a spider arm that may be conveniently attached and dismounted from the spider assembly without compromising the physical and mechanical integrity of the arm. It is a further objective to minimise, as far as possible, the time required to attach and remove the shield at the spider assembly whilst also minimising the number of personnel needed for attachment and dismantling.

It is a further objective to provide a releasable spider guard in which the mechanical attachments are positioned so as to be shielded from the falling crushable material to prevent attachment failure and undesired exposure of the arm and damage to the crusher.

The objectives are achieved by providing a multiple-point attachment mechanism that functions to draw the shield both radially inward towards the central hub and axially downward onto the upper region of the arm. In particular, attachment elements extend radially inward from a radially outermost region of the guard to journal the guard radially inward towards the central hub. A mount guide formed at a lower region of the shield acts to pull the shield axially downward onto the arm as the attachment elements are actuated. The mount guide also serves to prevent upward axial separation of the shield from the arm.

According to a first aspect of the present invention there is provided a gyratory crusher spider arm shield for releasable attachment to a spider arm that extends radially outward from a central hub and forms a part of a spider assembly positioned on a topshell frame of a gyratory crusher, the shield comprising: a main body having an underside foot for positioning on top of the spider arm, a first end for positioning at or towards the central hub and a second end for positioning at a region radially outward from the hub; a pair of sidewalls extending downwardly from the main body at each lengthwise side of the underside foot; characterised by: at least one attachment element extending radially inward from a region of the second end in a direction substantially towards the first end so as to be capable of engaging radially into the spider arm to journal the shield radially inward towards the hub; and a mount guide provided respectively at each sidewall to engage respective side regions of the spider arm and configured to guide the mating contact between the shield and the arm.

In particular, the mount guide is configured to journal the shield in an axially downward direction onto the arm. Preferably, each mount guide comprises a recess extending inwardly within each sidewall from an edge region of each sidewall. More preferably, each recess is orientated in each sidewall such that at least a region of each recess is angled upwardly in a direction from a lowermost edge at the respective sidewall towards the foot.

Advantageously, a lowermost edge of the recess is angled upwardly in a direction from a lowermost edge of each sidewall towards the foot. In particular, the lowermost edge of the recess provides an inclined abutment region that contacts the corresponding mount element projecting laterally from each side of the spider arm. Accordingly, each recess provides a set of jaws configured to engage around (at least partially) each laterally extending mount element (preferably in the form of a short lug).

Optionally, the attachment element comprises at least one bolt extending through the main body substantially from the second end. Preferably, the shield further comprises at least one depression at the second end to at least partially accommodate a head of a respective bolt. Preferably, the shield comprises two depressions in a form of cavity-like recesses extending radially inward from the radially outermost end region of the shield.

Preferably, the shield comprises a plurality of projections extending downwardly from the foot to engage onto a top region of the arm. Preferably, at least one projection is positioned towards the first end and at least one projection is positioned towards the second end of the main body.

According to a second aspect of the present invention there is provided a spider assembly for a gyratory crusher comprising: a central hub; a plurality of spider arms extending radially outward from the hub towards an outer rim; a plurality of arm shields releasably attached to the respective arms, each shield comprising: a main body having an underside foot for positioning on top of the spider arm, a first end for positioning at or towards the central hub of the spider assembly and a second end for positioning at a region radially outward from the hub; a pair of sidewalls extending downwardly from the main body at each lengthwise side of the underside foot; characterised in that: each shield comprises a mount guide provided at each respective sidewall and each spider arm comprises respective mount elements to engage with the respective mount guide and configured to guide the mating contact between the shield and the arm; and at least one attachment element to engage into a respective spider arm and to mate the respective mount elements and the mount guides to releasably secure the shield at the spider arm.

Preferably, the mount guide and the mount elements are configured to journal the shield in an axial downward direction onto the arm when mated together.

Preferably, each mount guide comprises a recess extending inwardly within each sidewall from an edge region of each sidewall. Preferably, each mount element comprises a lug projecting laterally from one side of the spider arm at a region between the hub and the outer rim.

Preferably, each arm comprises a pair of lugs, each lug projecting laterally from each side of the arm. Preferably the lugs are aligned concentrically and parallel with one another and extend substantially perpendicular to the main length of the spider arm that projects radially outward from the central hub. Preferably, a size of the recess is configured to at least partially receive the lug to inhibit upward axial movement of the shield relative to the arm when each lug is mated into each recess.

Optionally, the attachment element comprises at least one bolt extending through the main body substantially from the second end.

According to a third aspect of the present invention there is provided a gyratory crusher comprising: a topshell mounted upon a bottom shell and defining an internal crushing chamber; a main shaft supporting a mantle capable of gyroscopic precession within the crushing chamber; and a spider assembly and spider arm shields as detailed herein.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
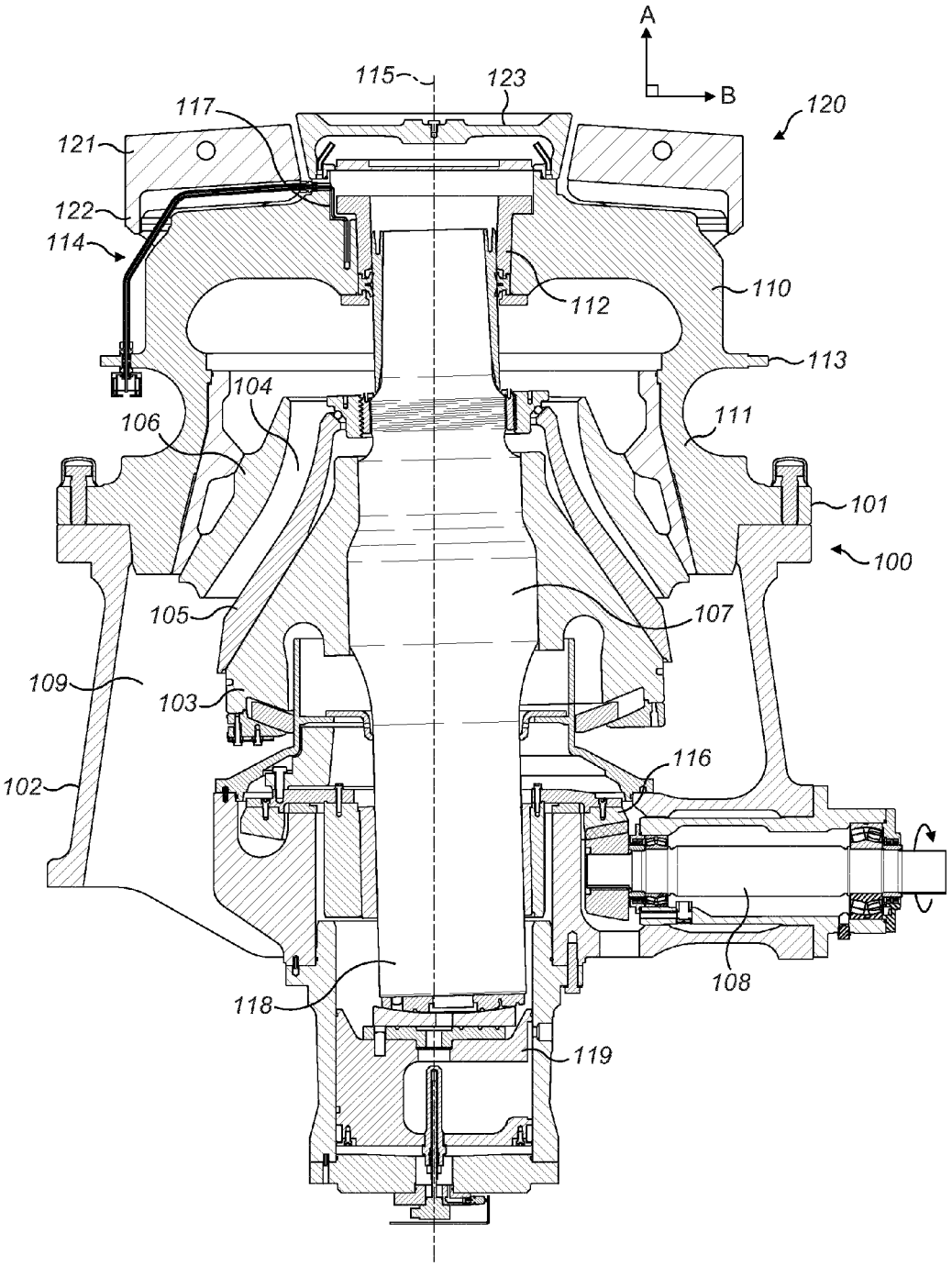
FIG. 1 is a cross sectional side view of a gyratory crusher having an upper frame part, a lower frame part and rotatable main shaft and a spider assembly mounted at the upper frame part to support and stabilise the main shaft according to a specific implementation of the present invention.
Figure 2A:
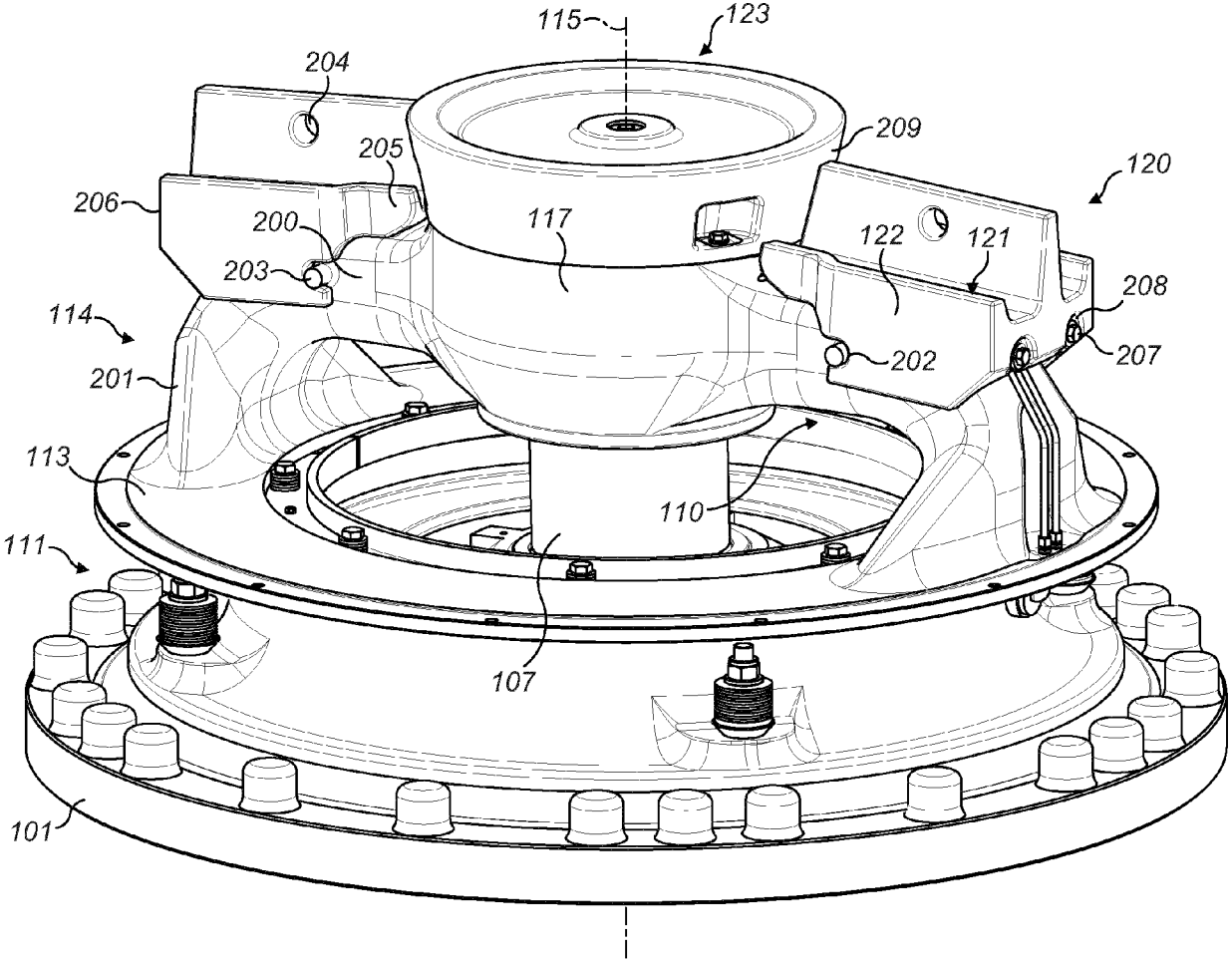
FIG. 2*a* is a perspective view of the spider assembly of FIG. 1 with arm shields secured in position over each respective spider arm according to a specific implementation of the present invention.
Figure 2B:
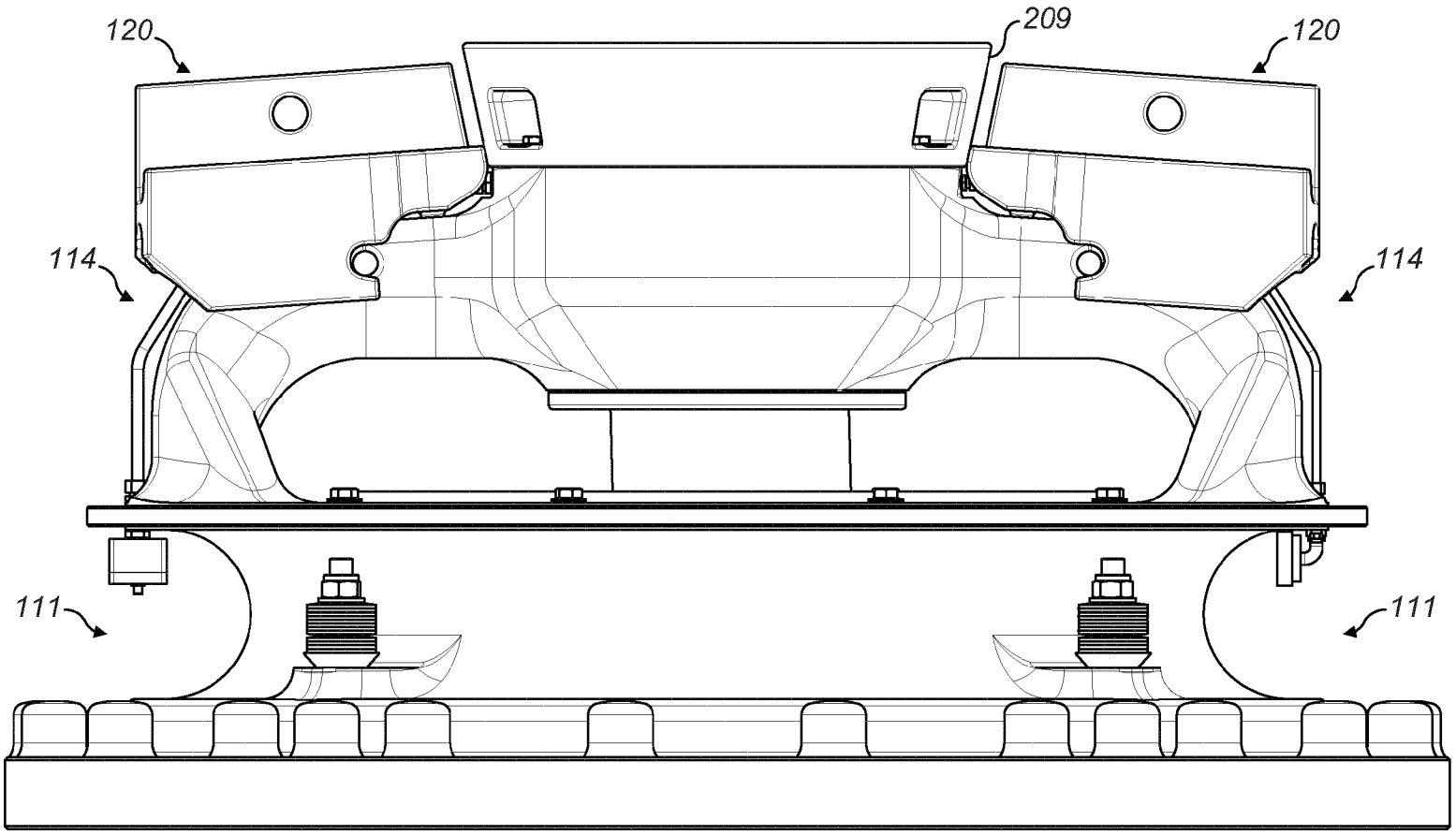
FIG. 2*b* is an external side elevation view of the arm shields and spider of FIG. 2*a;*
Figure 2C:
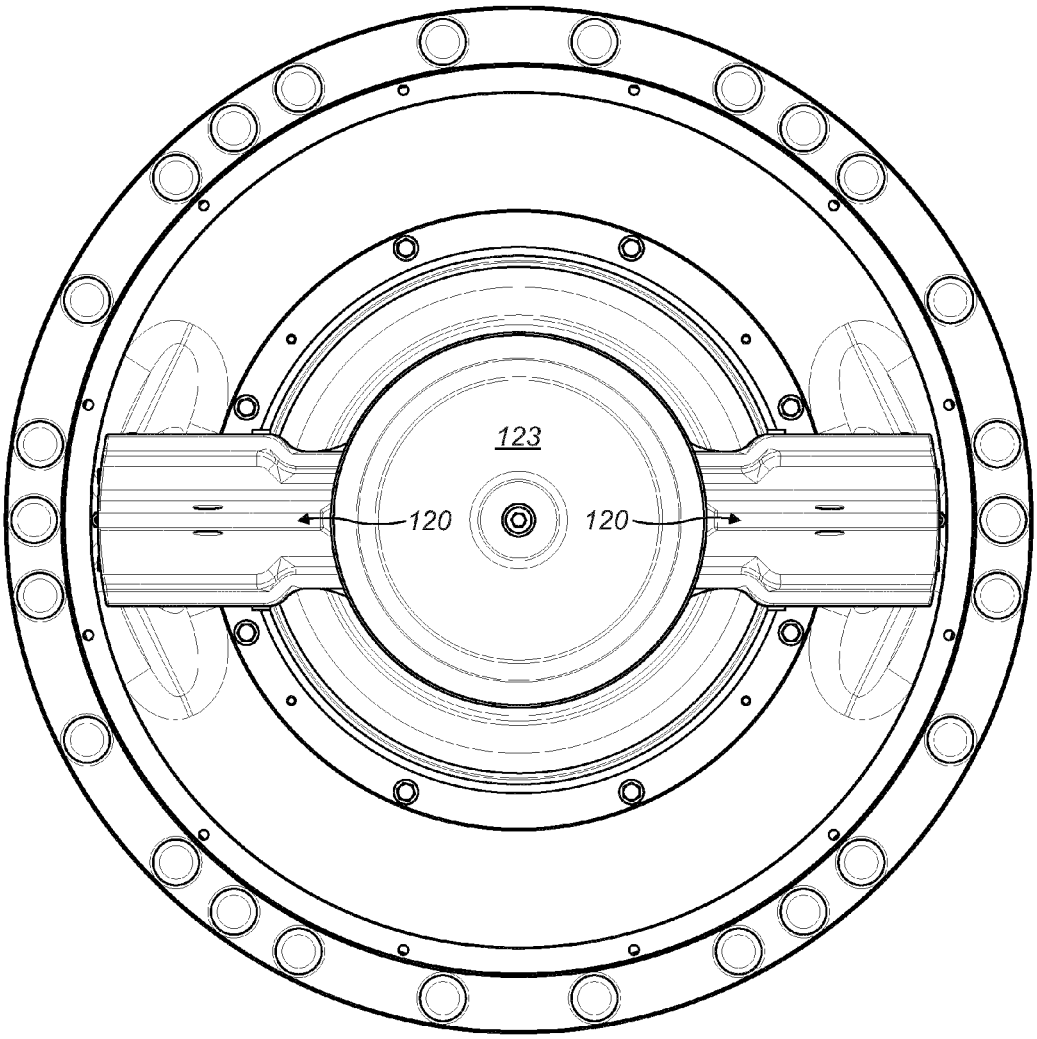
FIG. 2*c* is a plan view of the arm shields and spider of FIGS. 2*a* and 2*b;*
Figure 3:
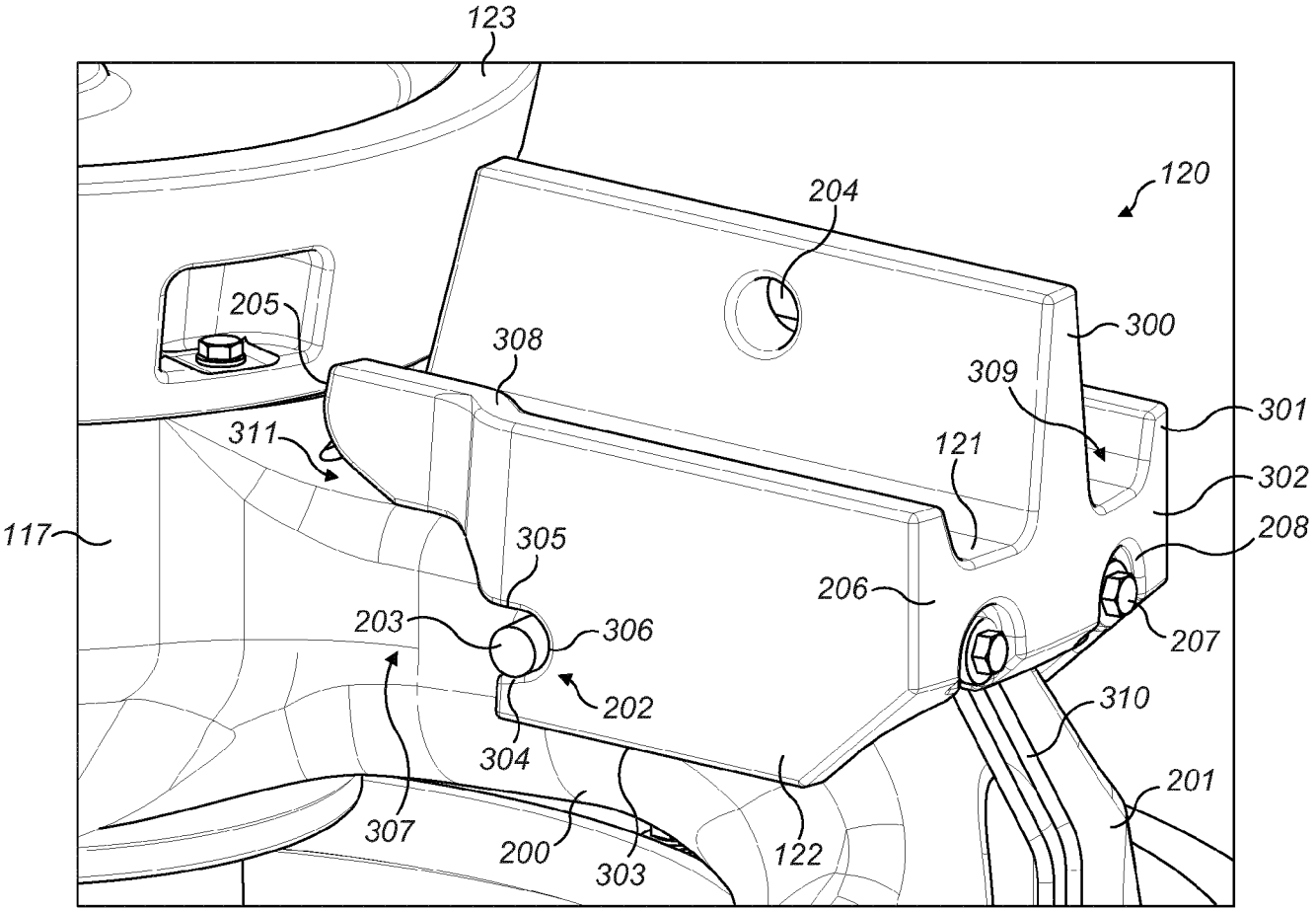
FIG. 3 is a magnified perspective view of one of the arm shields of FIG. 2*a;*

Referring to FIG. 1, a crusher comprises a frame 100 having an upper frame 101 and a lower frame 102. A crushing head 103 is mounted upon an elongate shaft 107. A first (inner) crushing shell 105 is fixably mounted on crushing head 103 and a second (outer) crushing shell 106 is fixably mounted at upper frame 101. A crushing zone 104 is formed between the opposed crushing shells 105, 106. A discharge zone 109 is positioned immediately below crushing zone 104 and is defined, in part, by lower frame 102.

A drive (not shown) is coupled to main shaft 107 via a drive shaft 108 and suitable gearing 116 so as to rotate shaft 107 eccentrically about longitudinal axis 115 and to cause head 103 to perform a gyratory pendulum movement and crush material introduced into crushing chamber 104. An upper end region of shaft 107 is maintained in an axially rotatable position by a top-end bearing assembly 112 positioned intermediate between main shaft 107 and a central boss 117. Similarly, a bottom end 118 of shaft 107 is supported by a bottom-end bearing assembly 119.

Upper frame 101 is divided into a topshell 111, mounted upon lower frame 102 (alternatively termed a bottom shell), and a spider assembly 114 that extends from topshell 111 and represents an upper portion of the crusher. The spider 114 comprises two diametrically opposed arms 110 that extend radially outward (in direction B) from a central boss 117 positioned on a longitudinal axis 115 extending through frame 100 and the gyratory crusher generally (indirection A). Arms 110 are attached to an upper region of topshell 111 via an intermediate annular flange (or rim) 113 that is centred around longitudinal axis 115. Typically, arms 110 and topshell 111 form a unitary structure and are formed integrally. A cap 123 extends over an upper region of shaft 107 and central boss 117 so as to protect the working components 112 at the upper region of the crusher. In order to protect the spider arms 110 from the crushable material that falls downwardly into the topshell 111, an arm shield 120 is mated onto and around each arm 110. Each shield 120 comprises a main body 121 that is configured to sit on top of arm 110 and a pair of sidewalls 122 that extend downwardly over each side of arm 110.

Referring to FIGS. 2*a* to 5*e*, each arm comprises a generally radially extending section 200 (aligned substantially with direction B) and a generally axially extending section 201 that projecting substantially downward (in direction A) from a radially outermost end of section 200. Arm section 201 terminates at an upper surface of rim 113. A shoulder 405 is located at the junction between section 200 and section 201.

The main body 121 of each shield is generally elongate and has a first end 205 and a second end 206. In use, first end 205 is configured for positioning against or towards central hub 117 and/or an outer circumferential surface 209 of central cap 123. An outermost second end 206 of shield 120 is positioned above the radially outermost region of arm section 201. Accordingly, a length of main body 121 between ends 205 and 206 is approximately equal to a length of region 200 in direction B.

Referring to FIGS. 3 to 5*a*, main body 121 comprises an underside surface region 400 for positioning directly over an uppermost surface region 311 of arm section 200. A first pair of cylindrical feet 401 project downwardly from surface 400 to contact arm surface 311 at a radial position towards central hub 117. A second pair of cylindrical feet 402 also extend from surface 400 to contact surface 311 towards the radially outermost part of arm section 200. That is, feet 401 are positioned towards first end 205 and feet 402 are positioned towards radially outermost second end 206. Feet 401, 402 rest on top of surface 311 to create a small gap between shield surface 400 and arm surface 311. A pair of parallel sidewalls 122 project downward from the lengthwise edges of main body 121. Each sidewall 122 terminates at a lowermost edge 303 that is aligned substantially at a mid-thickness region of arm section 200 in the axial direction A. Edge 303 terminates at its radially innermost region by edge 406 that tappers upwardly to return to main body 121 towards first end 205. An opposed radially outermost region of edge 303 terminates at edge 408 that tappers upwardly to second end 206 of main body 121. Each sidewall 122 comprises an opposed inward facing surface 500 configured for positioning opposed and against the opposed side surfaces 307 of arm section 200. In particular, wall surfaces 500 extend substantially perpendicular to foot surface 400 and sidewalls 122 extend approximately two thirds of the length of shield 120 between first and second ends 205, 206. Accordingly, the upper surface 311 and side surfaces 307 of arm section 200 are shrouded by shield 120 and in particular downward facing surface 400 and the opposed lateral side surfaces 500.

A recess 202 is formed in each wall 122 and extends inwardly from edge 406. Recess 202 comprises an innermost part circular section 306 that is connected to upper part of edge 406 by a substantially straight edge section 305. Edge 305 is aligned substantially parallel with the orientation of main body 121 and surfaces 400, 311. A lowermost part of curved edge 306 straightens into a lower edge region 304 that is inclined upwardly relative to the horizontal and surfaces 311, 400. Accordingly, recess 202 is formed as a short slot having at least a region that projects at an upward inclined angle within wall 122. In the radial direction B, recess 202 is positioned between radially innermost feet 401 and radially outermost feet 402 and in particular, at a position radially closer to feet 401 than feet 402.

Main body 121 comprises a radially outermost wall 502 that extends laterally between sidewalls 122 at second end 206. Wall 402 also projects downwardly from surface 400. A pair of slots 501 extend upwardly within wall 502 at end 206. Arm shoulder 405 is formed just below a radially outermost region of surface 311 and comprises a pair of threaded bore holes 404 orientated radially inward in direction B. Each slot 501 extends within a respective recessed depression region 208 formed in a radially outermost part of wall 502. Each depression 208, being a cavity-like region, is sized sufficiently to accommodate a head 207 an elongating bolt having at least a part threaded shaft 403. When guard 120 is secured to arm 110, each shaft 403 (of a pair of parallel bolts) is respectively inserted through slots 501 to engage into arm bores 404 at shoulder 405. Accordingly, shield 120 is journalled radially into central hub 117 as each bolt is tightened into bore 404. A radial depth of each depression 208 is configured such that each bolt head 207 does not protrude radially outward beyond a surface 302 at second end 206. Positioning the bolts in this radial orientation and accommodating heads 207 within depressions 208 is advantageous to prevent damage to the bolts by the crushable material falling downwardly onto shields 120.

Each arm 110 comprises a relatively short cylindrical lug 203 that projects laterally outward from each side surface 307 of each arm section 200. Each lug 203 is positioned slightly above the mid-point of arm section 200 in the axial direction A. A diameter of each lug 203 is slightly less than a diameter or width of recess 202 such that lug 203 is capable of being received within recess 202. When fully inserted in position, the curved outer cylindrical surface of lug 203 is mated against the arcuate innermost edge 306 of recess 202. In the fully mated configuration of FIGS. 1 to 4, shield 120 is prevented from displacement in axial direction A by mating of each lug 203 within each recess 202 and the attachment of shield 120 at arm 110 via the pair of bolts 207, 403 extending radially inward from second end 206.

Figure 4:
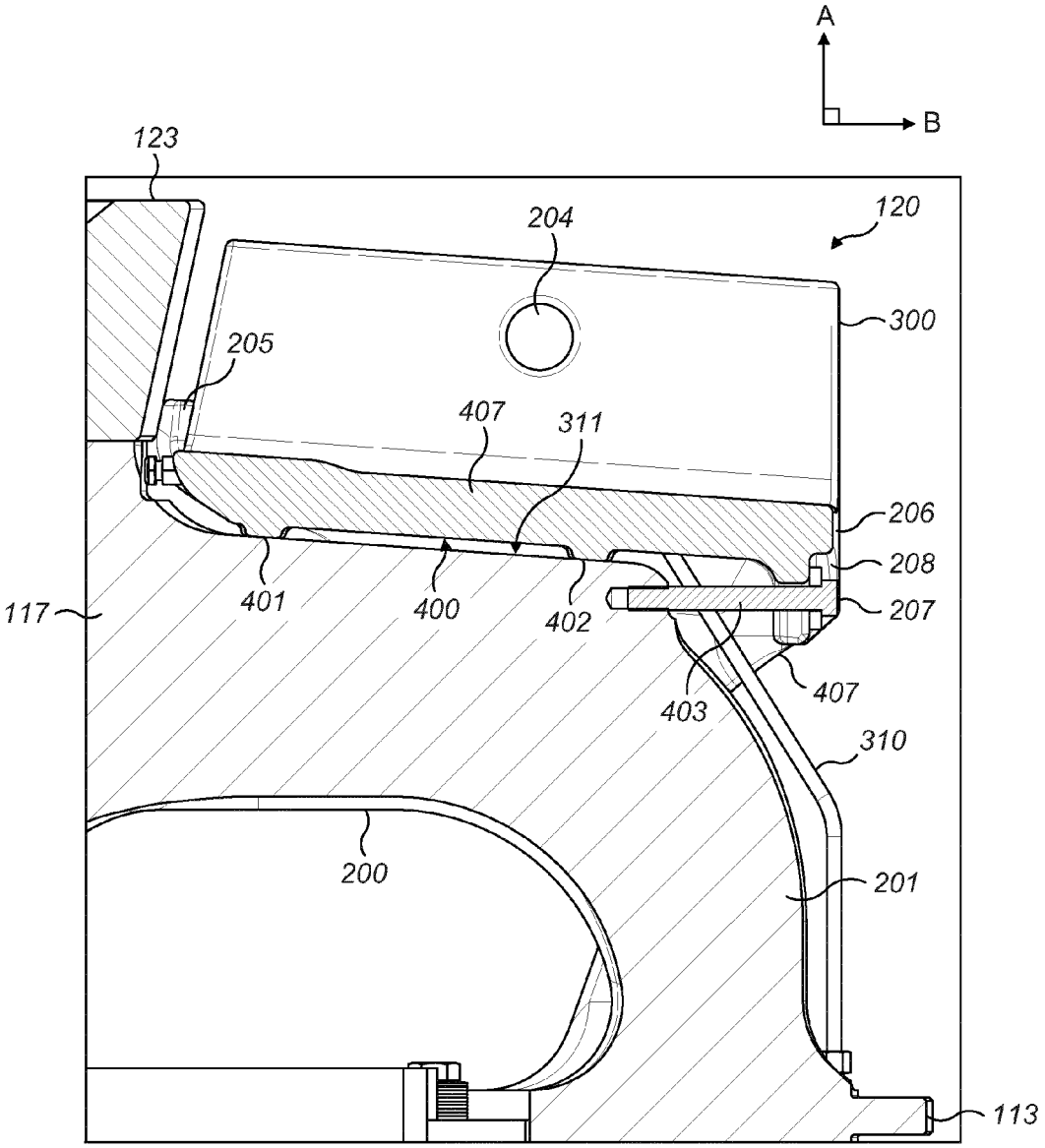
FIG. 4 is a side elevation cross section through one arm shield and spider arm of FIG. 2*b;*
Figure 5A:
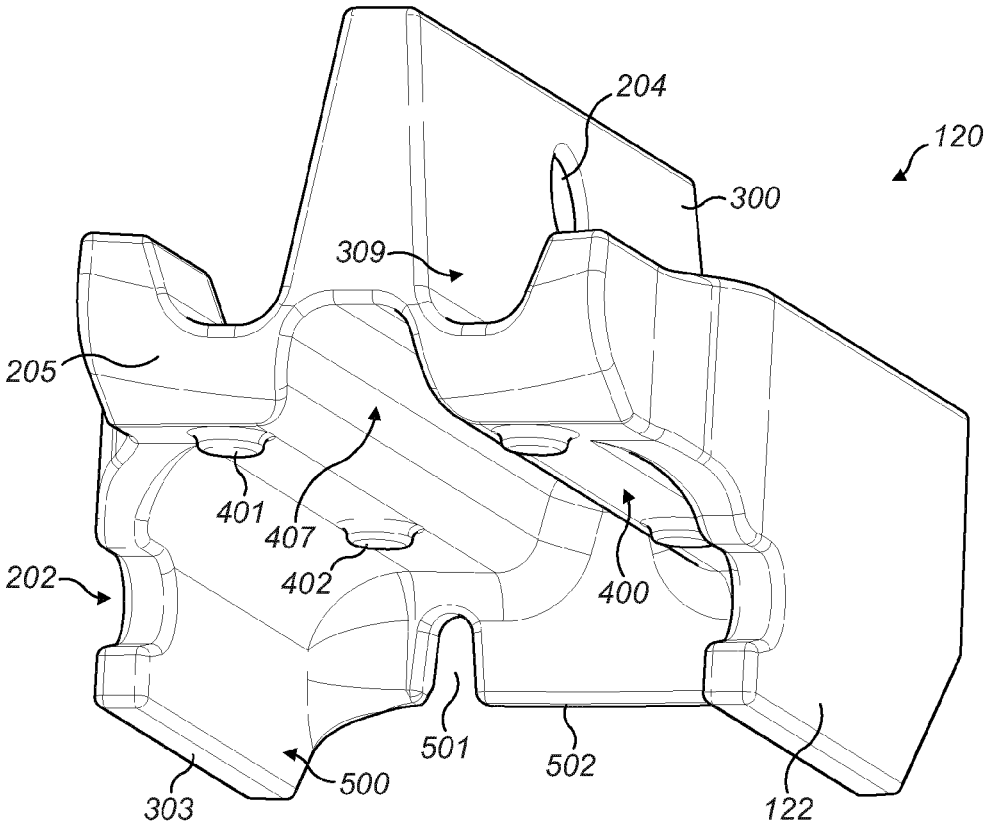
FIG. 5*a* is a perspective underside view of the shield of FIG. 4.
Figure 5B:
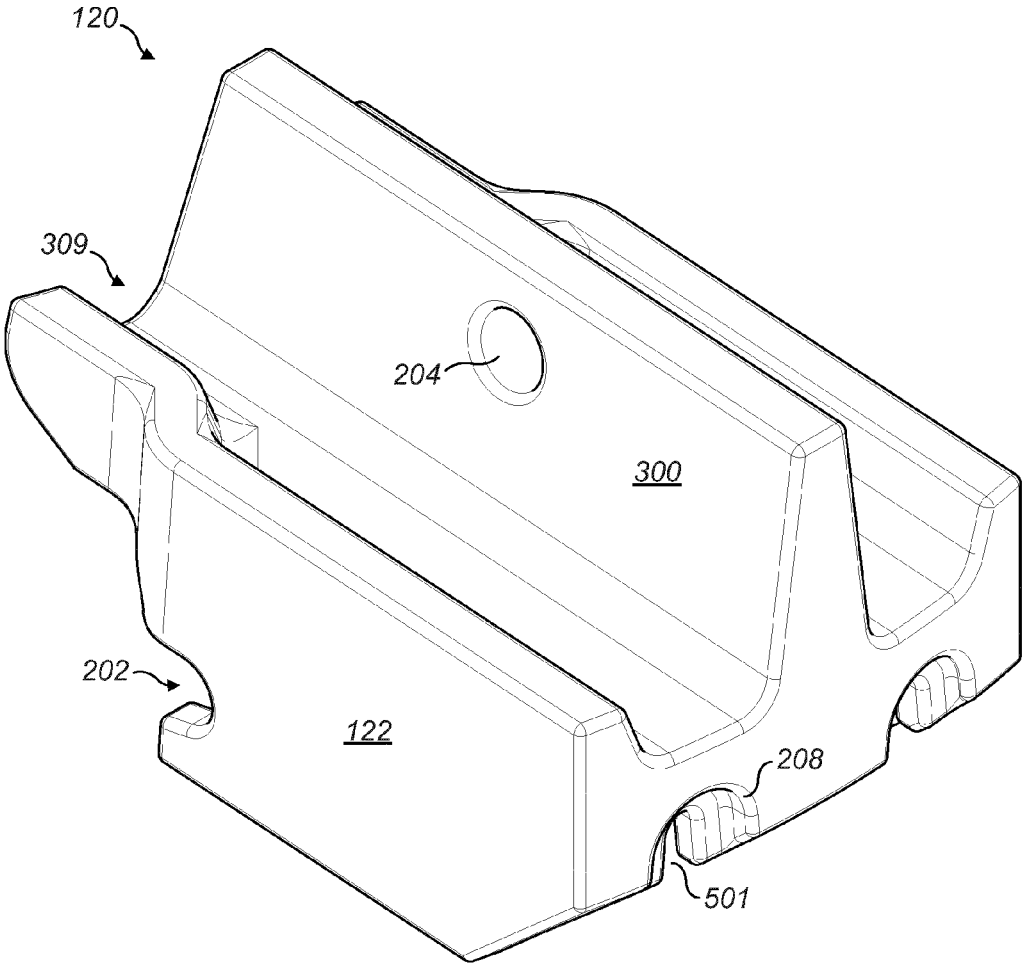
FIG. 5*b* is a perspective topside view of the shield of FIG. 5*a;*
Figure 5C:
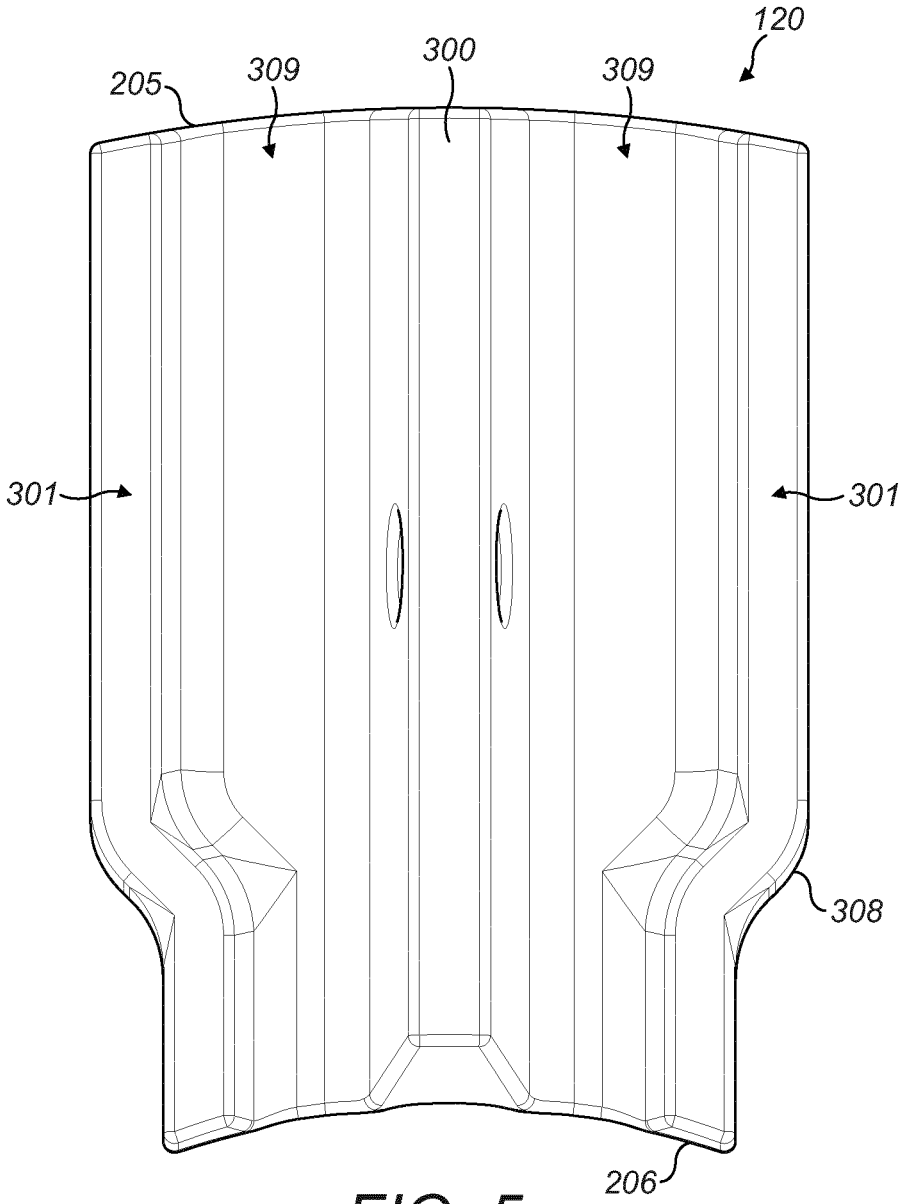
FIG. 5*c* is a plan view of the shield of FIG. 5*a;*
Figure 5D:
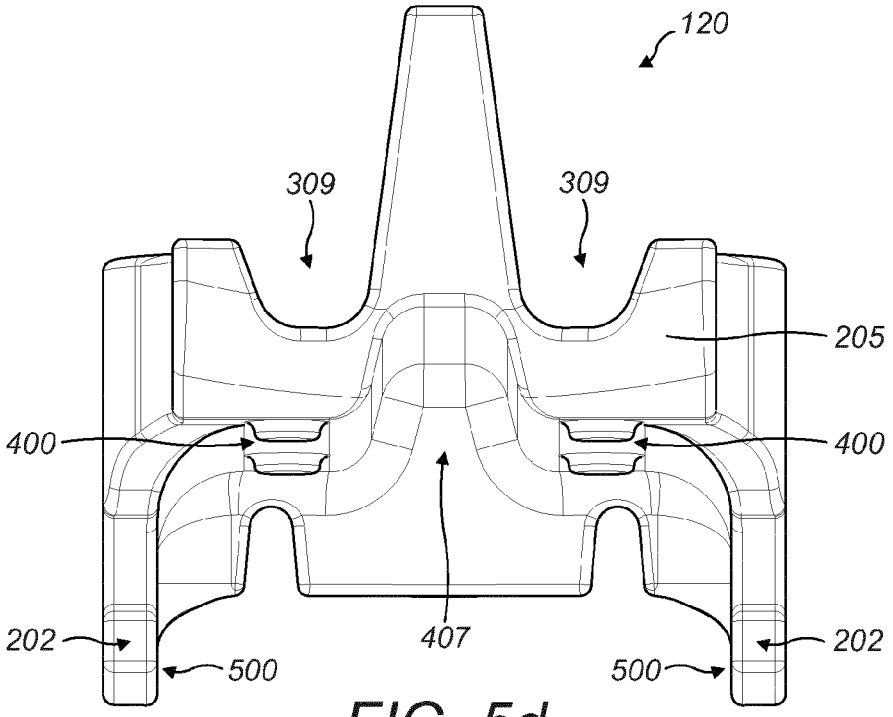
FIG. 5*d* is an end elevation view of the shield of FIG. 5*a* from a radially innermost end.
Figure 5E:
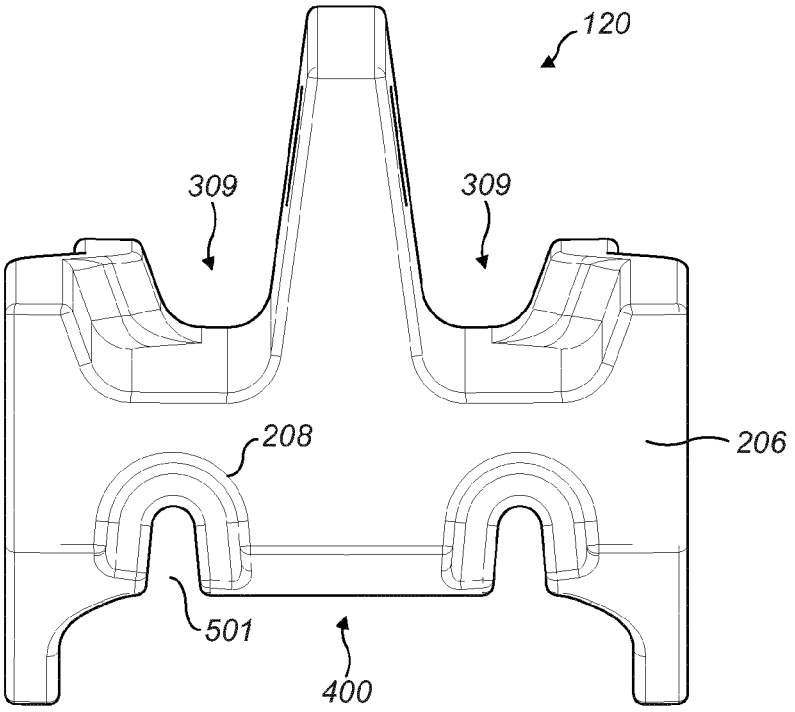
FIG. 5*e* is an end elevation view of the shield of FIG. 5*a* from a radially outermost end.

A channel 407 extends lengthwise along main body 121 and is recessed upwardly in surface 400. As illustrated in FIGS. 4 and 5*a*, channel 407 is configured to accommodate lubrication tubing 311 that extends around an upper region of arm 110.

Main body 121 comprises three upwardly projecting flanges 300, 301. Flanges 300, 301 extend the full length of arm shield 120 between first and second ends 205, 206. Flange 300 extends axially upward from a mid-region of main body 121 and is aligned approximately centrally over arm 110. A pair of side flanges 301 are positioned directly above walls 122 and project radially upward in direction A from the end lengthwise edges of main body 121. A distance by which central flange 300 extends from main body 121 is approximately twice the corresponding height of side flanges 301. Accordingly, a pair of parallel elongate channels 309 is defined by flanges 300, 301. In use, channels 309 are configured to collect crushable material as it falls downwardly onto each shield 120. An aperture 204 extends through a mid-point of flange 300 to receive a hook or engaging end of lifting apparatus used to remove each shield 120 axially upward for maintenance and repair.

A width of each shield 120 in the lateral direction over arm region 200 decreases via a pair of opposed curved regions 308 located radially between recess 202 and first end 205. Each curved region 308 effectively terminates the radially innermost end of each sidewall 122 such that the radially innermost region of each shield 120 is located exclusively above arm section 200 towards first end 205.

To attach each shield 120 to a respective arm 110, the feet 401, 402 are mated onto arm surface 311 such that sidewalls 122 project laterally downward over arm section 200 with surfaces 500 and 307 being opposed. Shaft 403 of each attachment bolt is inserted through slots 501 to engage into arm the respective shoulder bore 404. As each bolt 207, 403 is screwed into shoulder 405 and the entire shield 120 is journalled radially inward in direction B. Additionally, due to the shape, configuration and relative position of each recess 202, shield 120 is also journalled axially downward in direction A, principally due to the inclined edge 304 that mates and abuts against the outer surface of lug 203. As bolts 207, 403 are tightened, lug 203 is mated into recess 202. Accordingly, each shield 120 is secured to arm 110 via a plurality of points of contact including in particular contact between: feet 401 and 402 and surface 311; lug 203 and recess 202 and; bolt shafts 403 and shoulder 405.

Due to the positioning of each recess 202 in a radial direction relative to feet 401, 402 the entire shield 120 is prevented from rotation. Also, a secure attachment is achieved by the radially inward orientation of attachment bolts 207, 403 that serves to journal mating contact between the laterally extending arm lugs 203 and each guard recess 207.

The invention claimed is:

1. A gyratory crusher spider arm shield for releasable attachment to a spider arm that extends radially outward from a central hub and forms a part of a spider assembly positioned on a topshell frame of a gyratory crusher, the shield comprising:

a main body having an underside foot for positioning on top of the spider arm, a first end for positioning at or towards the central hub and a second end for positioning at a region radially outward from the hub;

a pair of sidewalls extending downwardly from the main body at each lengthwise side of the underside foot;

at least one attachment element extending radially inward from a region of the second end in a direction substantially towards the first end and arranged to engage radially into the spider arm to journal the shield radially inward towards the hub; and a mount guide provided respectively at each sidewall to engage respective side regions of the spider arm and configured to guide the mating contact between the shield and the arm.

2. The shield as claimed in claim 1, wherein each mount guide includes a recess extending inwardly within each sidewall from an edge region of each sidewall.

3. The shield as claimed in claim 2, wherein each recess is orientated in each sidewall such that at least a region of each recess is angled upwardly in a direction from a lowermost edge at the respective sidewall towards the foot.

4. The shield as claimed in claim 2, wherein a lowermost edge of the recess is angled upwardly in a direction from a lowermost edge of each sidewall towards the foot.

5. The shield as claimed in claim 1, wherein the attachment element includes at least one bolt extending through the main body substantially from the second end.

6. The shield as claimed in claim 5, further comprising at least one depression at the second end to at least partially accommodate a head of a respective bolt.

7. The shield as claimed in claim 1, further comprising a plurality of projections extending downwardly from the foot to engage onto a top region of the arm.

8. The shield as claimed in claim 7, wherein at least one projection is positioned towards the first end and at least one projection is positioned towards the second end of the main body.

9. A spider assembly for a gyratory crusher comprising:

a central hub;

a plurality of spider arms extending radially outward from the hub towards an outer rim; and a plurality of arm shields each releasably attached to a respective arm, each shield including a main body having an underside foot for positioning on top of the spider arm, a first end for positioning at or towards the central hub of the spider assembly and a second end for positioning at a region radially outward from the hub, a pair of sidewalls extending downwardly from the main body at each lengthwise side of the underside foot, a mount guide provided at each respective sidewall and each spider arm having respective mount elements engaging with a respective mount guide and configured to guide the mating contact between the shield and the arm, and at least one attachment element to engage into a respective spider arm and to mate the respective mount elements and the mount guides to releasably secure the shield at the spider arm.

10. The spider assembly as claimed in claim 9, wherein each mount guide includes a recess extending inwardly within each sidewall from an edge region of each sidewall.

11. The spider assembly as claimed in claim 9, wherein each mount element includes a lug projecting laterally from one side of the spider arm at a region between the hub and the outer rim.

12. The spider assembly as claimed in claim 11, wherein each arm includes a pair of lugs, each lug projecting laterally from each side of the arm.

13. The spider assembly as claimed in claim 10, wherein a size of the recess is configured to at least partially receive the lug (203) to inhibit upward axial movement of the shield relative to the arm when each lug is mated into each recess.

14. The spider assembly as claimed in claim 9, wherein the at least one attachment element includes at least one bolt extending through the main body substantially from the second end.

15. A gyratory crusher comprising:

a topshell mounted upon a bottom shell and defining an internal crushing chamber;

a main shaft supporting a mantle capable of gyroscopic precession within the crushing chamber; and a spider assembly the spider assembly including a central hub, a plurality of spider arms extending radially outward from the hub towards an outer rim, and a plurality of arm shields each releasably attached to a respective arm, each shield including a main body having an underside foot for positioning on top of the spider arm, a first end for positioning at or towards the central hub of the spider assembly and a second end for positioning at a region radially outward from the hub, a pair of sidewalls extending downwardly from the main body at each lengthwise side of the underside foot, a mount guide provided at each respective sidewall and each spider arm having respective mount elements engaging with a respective mount guide and configured to guide the mating contact between the shield and the arm, and at least one attachment element to engage with a respective spider arm and to mate the respective mount elements and the mount guides to releasably secure the shield at the spider arm.

* * * * *